US006262661B1

(12) United States Patent
Mahler et al.

(10) Patent No.: US 6,262,661 B1
(45) Date of Patent: Jul. 17, 2001

(54) PASSIVE INFRARED DETECTOR

(75) Inventors: Hansjürg Mahler, Hombrechtikon; Stefan Hegnauer, Dübendorf, both of (CH)

(73) Assignee: Siemens Building Technologies, AG Cerberus Division, Mannedorf (CH)

( * ) Notice: Subject to any disclaimer, the term of this patent is extended or adjusted under 35 U.S.C. 154(b) by 0 days.

(21) Appl. No.: 09/689,993

(22) Filed: Oct. 13, 2000

(30) Foreign Application Priority Data

Oct. 14, 1999 (EP) ..... 99120434

(51) Int. Cl.[7] ..... G08B 13/18

(52) U.S. Cl. ..... 340/567; 340/565; 340/506; 340/521; 250/353; 250/341; 250/342; 359/193; 359/187; 359/115; 359/189

(58) Field of Search ..... 340/567, 565, 340/506, 521; 250/353, 341, 342; 359/193, 187, 115, 189

(56) References Cited

U.S. PATENT DOCUMENTS

| | | | | |
|---|---|---|---|---|
| 4,709,153 | | 11/1987 | Schofield | 250/353 |
| 4,746,910 | | 5/1988 | Pfister et al. | 340/567 |
| 4,752,768 | * | 6/1988 | Steers et al. | 340/567 |
| 4,982,094 | * | 1/1991 | Matsuda | 250/342 |
| 5,499,016 | * | 3/1996 | Pantus | 340/555 |
| 5,942,976 | * | 8/1999 | Weiser et al. | 340/565 |

FOREIGN PATENT DOCUMENTS

| | | |
|---|---|---|
| 0289621 | 11/1988 | (EP) . |
| 0499177 | 8/1992 | (EP) . |

* cited by examiner

*Primary Examiner*—Daniel J. Wu
*Assistant Examiner*—Tai T. Nguyen
(74) *Attorney, Agent, or Firm*—BakerBotts LLP

(57) ABSTRACT

The infrared detector contains an entrance window for infrared radiation, an infrared sensor with an evaluation circuit and an anti-masking device having an optical transmitter and an optical receiver for detecting phenomena or optical changes immediately in front of the detector and/or changes in the optical properties of the entrance window. The signals of the anti-masking device are evaluated in two channels, wherein one channel responds to temporally limited phenomena or changes and the other channel responds to temporally stable phenomena or changes. A combined evaluation of the signals in the two channels takes place. In the combined evaluation, the channel processing the signals of the infrared sensor is preferably also included. As a result, the infrared detector acquires an increased immunity to false alarms and a higher sensitivity.

19 Claims, 1 Drawing Sheet

PASSIVE INFRARED DETECTOR

BACKGROUND OF INVENTION

The present invention relates to passive infrared detectors and more particularly relates to an infrared sensor having an anti-masking device.

FIELD OF THE INVENTION

Known sabotage or masking methods to defeat passive infrared detectors include covering the detector with an object, such as, for example, a box, a hat or a screen, or spraying the entrance window with a spray that is opaque to infrared, such as, for example, glue or hairspray. Modern passive infrared detectors should be capable of automatically detecting such masking, preferably at the time of the masking or, at the latest when the detector or system is set. There are various strategies in this regard. In the case of detectors connected to a monitoring center, the detectors are always switched on and deliver signals to the center even while they are not set (e.g., in the standby mode). However, in standby mode, the center does not treat the received signals as alarm conditions but can use such signals for diagnostic purposes. Therefore, with the detector always switched on, the center can detect sabotage attempts without a time delay.

Anti-masking devices, such as those described, for example, in EP-A-0 186 226, in EP-A-0 449 177 and in EP-A-0 556 898, serve to detect attempts to sabotage the detector, such as, for example, by covering the entrance window with a foil or a cover or by spraying the entrance window with a spray that is opaque to infrared, such as, for example, hair lacquer. Phenomena or optical changes immediately in front of the detector, such as covering the detector, in most cases effect a reflection of the radiation emitted by the optical transmitter of the anti-masking device onto the optical receiver, which is manifested in a clearly defined change in the radiation received by the optical receiver.

Anti-masking devices generally include an optical transmitter and an optical receiver which are generally formed by an infrared LED and an infrared diode. Changes in the optical properties of the entrance window are then detected by measuring either the radiation and the radiation passing through the entrance window or reflected by it. In the case of an anti-masking device described in EP-A-0 772 171, an optical diffraction lattice structure is mounted on the outside of the entrance window and focuses the light emitted by the optical transmitter on the infrared detector. In the event of sabotage by spraying the entrance window, the focusing action of the optical refraction lattice structure is destroyed, with the result that the intensity of the light falling on the infrared detector is reduced.

To evaluate the signals of the anti-masking device, the signals of the optical receiver are generally compared with threshold or reference values. These values generally correspond to voltage values that have to be exceeded (or not reached) and maintained over a certain time interval.

The evaluation of the signals is usually carried out by one of two known methods. One method is the so-called proximity-latch (PL) method in which a masking alarm is triggered as soon as the predetermined criteria are reached. The alarm then remains active and can only be reset by an authorized individual by a specified procedure. The PL, method therefore responds rapidly and in a sharply defined manner. However, the method has a drawback in that the alarm can be set, in the case of short movements without any intent to mask, and the alarm cannot be reset automatically, but requires the intervention of an operator. The second method is the so-called real-time (RT) method, in which only sufficiently large and sufficiently stable changes trigger a masking alarm. This is automatically canceled when the signals return to the normal state. The RT method responds more slowly and tends to be less sharply defined, but has the advantage of automatic alarm cancellation.

Regardless of whether the signal is evaluated by the PL or the RT method, it is necessary to ensure that the threshold or reference values are chosen very much on the "safe" side so that the smallest changes in the environmental conditions do not trigger a false masking alarm. Such changes may be formed, for example, by insects, temperature variations, dust deposits or nicotine deposits, but occasionally also by mechanical vibrations or atmospheric pressure changes. This means that both in the case of both the PL method and in the case of the RT method, a compromise has to be sought between sensitivity and immunity to masking alarms. Such a compromise may have the result that, in certain cases, maskings are not discovered or, alternatively, a false masking alarm is inadvertently triggered.

SUMMARY OF THE INVENTION

The object of the invention is therefore to provide a passive infrared detector having a masking alarm device that has both an increased immunity to false alarms and a higher sensitivity.

This object is achieved, according to the invention, in that the signals of the anti-masking device are evaluated in two channels, wherein one channel, designated below as PL, channel, responds to temporally limited phenomena or changes and the other channel, designated below as RT channel, responds to temporally stable phenomena or changes, and in that a combined evaluation of the signals in both channels is carried out.

In the passive infrared detector according to the invention, the PL method and the RT method are mutually combined, the greatest advantage of this combination being that the threshold or reference values can be set lower in the individual channels or possibly omitted completely. The latter may be the case if the signals are evaluated using fuzzy logic or in a neural network.

A first embodiment of the passive infrared detector according to the invention is characterized in that, in each channel, the signal is investigated by comparison with at least one threshold or reference value or by means of fuzzy logic, and in that the combined evaluation is formed by a combination of the test results in the two channels.

A second embodiment of the passive infrared detector according to the invention is characterized in that, in each channel, various values are defined for pre-alarm stages in addition to the threshold or reference value corresponding to the respective alarm stage, and in that the signals are compared with the pre-alarm and alarm stages.

A third embodiment of the passive infrared detector according to the invention is characterized in that the combined evaluation of the signals of the two channels of the anti-masking device is combined with that evaluation of the signals of the infrared sensor that is carried out in a channel that is designated below as PIR channel, and in that intrusion or masking alarms are triggered on the basis of the signals in all three channels. This embodiment provides a further increase in the immunity to false alarms since it makes the detector largely immune to malfunctions due to insects. For example, if a fairly large insect is moving in the vicinity in front of the entrance window, that can result in an alarm signal being triggered in the PIR channel. Since, however, the insect would also trigger an alarm signal in the PL channel, the signal in the PIR channel can be disabled on the basis of the alarm signal in the PL channel. On the other hand, an alarm signal in the PIR channel without a simultaneous alarm signal in the PL channel would be a true intrusion alarm, and an alarm signal in the PIR channel with simultaneous alarm signals in the PL channel and in the RT channel would indicate a masking attempt.

BRIEF DESCRIPTION OF THE DRAWINGS

The invention is described in more detail below by reference to an exemplary embodiment and the drawings; in the drawings.

DESCRIPTION OF PREFERRED EMBODIMENTS

Figure 2:
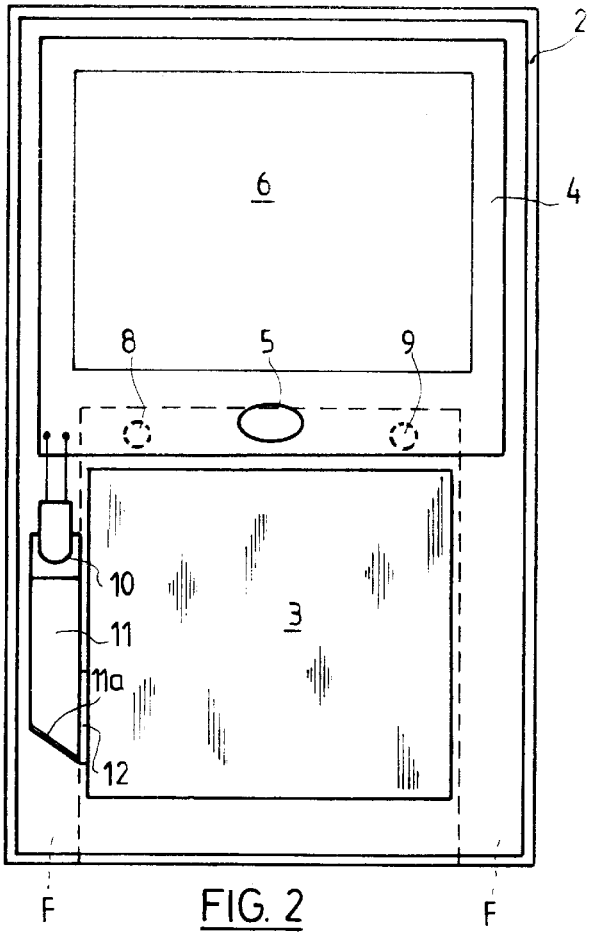
FIG. 2 shows a view in the direction of the arrow II in FIG. 1.
Figure 1:
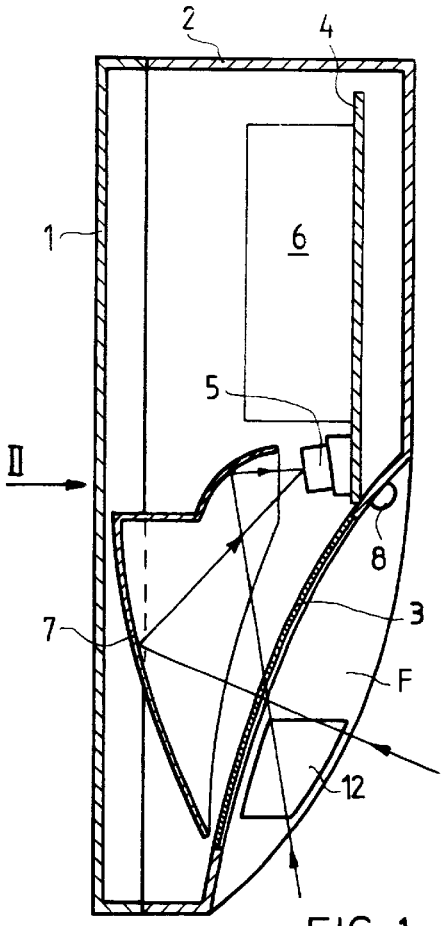
FIG. 1 shows a longitudinal section through a passive infrared detector according to the invention.

FIG. 1 shows a longitudinal section through a passive infrared detector according to the invention in the direction perpendicular to its rear wall or base. FIG. 2 shows the detector of FIG. 1 from a view from the rear, in which the rear wall of the detector and the mirror that focuses the incident infrared radiation has been removed from the detector. Referring to FIG. 1, the passive infrared detector essentially comprises a two-part casing with a base 1 and a cover 2. An entrance window 3 is provided in the cover 2 to admit the infrared radiation incident on the detector from the room to be kept under surveillance. A printed circuit board 4 is disposed in the interior of the detector and on which, inter alia, an infrared sensor 5 and an evaluation circuit 6 are disposed. A mirror 7, likewise disposed in the interior of the detector, is provided for focusing the infrared radiation incident on the infrared sensor 5 through the entrance window 3.

The entrance window 3, which is composed, for example of polyethene or polypropylene and is substantially transparent to radiation in the wavelength range from approximately 5 to 15 $\mu$m, is set in a sloping or concave part of the cover 2 and is bounded laterally by protrusions F of the cover 2. The mirror 7 is preferably designed in such a way that it absorbs radiation in the near infrared and reflects body radiation. In regard to the shape of the mirror, reference is made to EP-A-0 303 913 and in regard to the mirror material, reference is made to EP-A-0 707 294, the contents of which are hereby incorporated by reference in their entirety. Alternatively, entrance window 3, the mirror 7, the infrared sensor 5 and the evaluation circuit 6 serve to detect the intrusion of an individual into the room under surveillance. The entrance window 3 can be designed as a Fresnel lens and can directly focus the infrared radiation on the infrared sensor 5 without the use of mirror 7.

The passive infrared detector shown is equipped with a so-called anti-masking device for detecting phenomena or optical changes immediately in front of the detector and changes in the optical properties of the entrance window 3, in particular, sabotage of the detector. Such sabotage serves to manipulate the detector in such a way that infrared radiation is prevented from reaching the infrared sensor. As a result, unauthorized individuals are no longer detected and can move freely in the room under surveillance. Sabotage is generally perpetrated while the detector is not set, e.g., when the latter is switched to the standby mode and individuals in the room under surveillance do not trigger an alarm.

The anti-masking device of the present detector is designed so that it can reliably detect the two most common masking methods. Disposed on the front of the detector just above the entrance window 3 are an optical transmitter 8, for example an infrared LED having a wavelength of about 950 nm, and an optical receiver 9, for example an infrared photodiode. The transmitter 8 is disposed on the outside of the casing cover 2 and the receiver 9 is located on the inside. The transmitter 8 continuously radiates infrared radiation from the detector, such that infrared radiation is radiated into the room under surveillance in front of the detector in the normal operating state. However, when an object is placed just in front of the detector or is situated there, a large portion of the radiation transmitted by the transmitter 8 is reflected and passes through the entrance window 3 onto the receiver 9. The increase in the radiation received as a result of this reflection is interpreted as a masking attempt.

Disposed in the interior of the detector in the vicinity of at least one of the two wings F is an additional optical transmitter 10, for example an infrared LED, that transmits infrared radiation into a light duct 11. The light duct 11 is of angled design and opens into a window 12 that is substantially transparent to infrared and that is provided in that side wall of the respective protrusion F facing the entrance window 3. The infrared radiation transmitted by the additional transmitter 10 passes through the light duct 11 via a mirror 11*a* and the window 12 at a shallow angle of incidence onto the entrance window 3. Under normal conditions, this radiation passes through the entrance window 3. The radiation transmitted by the additional transmitter 10 is focused by the window 12 on the center of the entrance window 3 and passes through the latter onto the receiver 9. If, however, the entrance window 3 is masked, that is to say has been rendered substantially opaque to infrared, radiation of the additional transmitter 10 incident on the entrance window is reflected by the entrance window 3 and less radiation reaches the receiver 9, which is interpreted as a masking attempt. To avoid reflections of the radiation of the additional light source 10 emerging from the window 12 at the side wall of the protrusion F opposite the window 12, the side wall of protrusion F is preferably provided, at least partially, with an infrared-absorbing coating.

Figure 3:
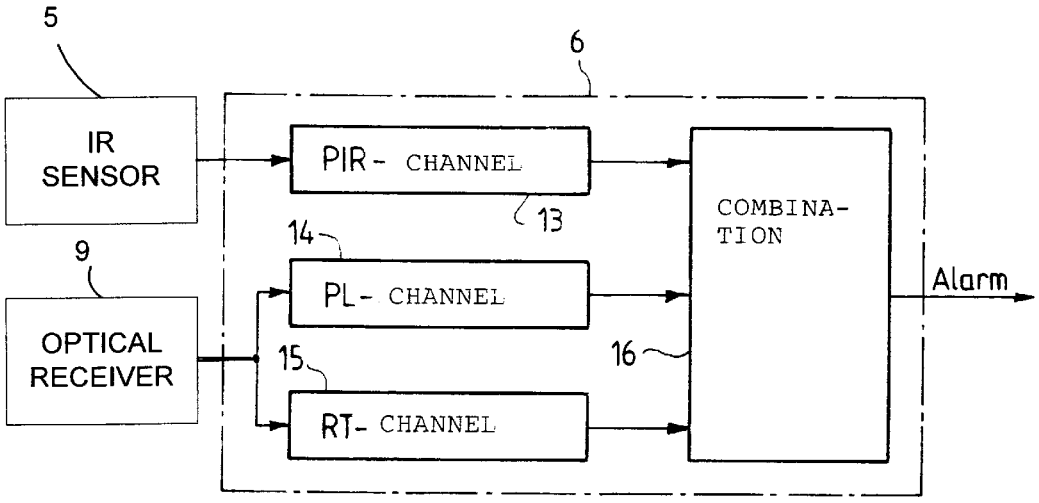
FIG. 3 shows a block diagram of the signal evaluation circuit.

According to FIG. 3, the evaluation circuit 6 contains a PIR channel 13 connected to the infrared sensor 5 and two channels, a PL channel 14 and an RT channel 15, both of which are connected to the optical receiver 9. The outputs of all three channels are fed to a processing stage 16 in which the signals of the channels are combined. The result of this combination forms the decision basis for the delivery of an alarm signal by the detector. As a variant, only the outputs of the PL channel 14 and of the RT channel 15 may be combined with one another.

The PIR channel 13 is the channel, present in every passive infrared detector, for evaluating the signal of the infrared sensor 5 exposed to the infrared radiation from the room under surveillance. At the output of PIR channel is a signal that can be obtained that indicates the intrusion of an object transmitting infrared radiation into the room under surveillance. The construction and operation of the PIR channel 13 is well known, and a more detailed description is omitted from the disclosure.

The proximity latch (PL) channel 14 and the real time (RT) channel 15 serve to evaluate the anti-masking signal of the optical receiver 9. The scanning rate and resolution are chosen in such a way that they are adequate for both channels. Both in the PL, channel 14 and in the RT channel 15, the signal of optical receiver 9 is compared with an alarm threshold and preferably also with a plurality of pre-alarm thresholds. When the pre-alarm thresholds are used, the output of the respective channels can provide information regarding the nature of the signal, such as a small, medium or large signal. The use of pre-alarm thresholds not only has the advantage that further logical combinations thereby become possible, but also that the fulfillment of country-specific regulations is facilitated.

Characteristic of the PL channel 14 is that a masking alarm or pre-alarm is triggered even in the case of the threshold being exceeded briefly. The PL channel is not automatically reset, but requires intervention by the system's user. This mode is typical of an operating mode in which the system is checked by the staff prior to setting, on which occasion any masking alarms can be reset. On the other hand, the RT channel 15 responds to temporally stable, that is to say longer-lasting, overshoots of the respective threshold or reference values. A masking alarm is triggered only if the threshold is crossed for a sufficient time period. In addition, the masking alarm in the RT channel is automatically reset without the intervention of the user as soon as the overshoot disappears again and the detector returns to its normal state.

An advantage of combining the two channels 14 and 15 is that a masking alarm is triggered only if both of the two channels indicate an alarm condition. As a result, the rate of occurrence of false alarms is reduced. In addition, as a result of the combination, it is possible to choose the threshold or reference values more precisely in each channel because it is unnecessary to always be on the "safe" side with respect to false alarm prevention. Finally, all the threshold values, or at least some, may be dispensed with and broad values employed instead. The broad values can be processed by appropriate rules of fuzzy logic or, alternatively, in a neural network (in this connection, see, for example, EP-A-O 646 901).

If, for example, there is a pre-alarm signal in the PL channel 14, i.e., a threshold value of 50% of the alarm value has been exceeded, and if a long pre-alarm signal occurs in the RT channel 15, this indicates masking and a masking alarm is triggered. If only one of the PL or the RT channels is triggered, on the other hand, no alarm would be triggered. For example, if an alarm signal occurs in the PL channel 14 without a pre-alarm signal occurring in the RT channel 15, such as might occur if a fairly large insect passed in front of the detector, no alarm is triggered. Thus, the combined evaluation of the PL channel 14 and the RT channel 15 results in higher sensitivity and in higher false alarm immunity.

The immunity to false alarms is increased further, not only to masking false alarms but also to intrusion false alarms, if the PIR channel 13 is included in the combination of the PL channel 14 and the RT channel 15. Thus, for example, the large insect mentioned in the last example could trigger a PIR alarm, but the latter can be suppressed if an alarm signal is simultaneously present in the PL channel 14. On the other hand, an alarm signal in the PIR channel 13 without an alarm signal in the PL channel is interpreted as a true intrusion alarm. Further, an alarm signal in the PIR channel 13 together with an alarm signal in PL channel 14 and in RT channel 15 is interpreted as a masking attempt and a corresponding alarm signal is emitted.

What is claimed is:

1. A passive infrared detector having an entrance window for infrared radiation, an infrared sensor with an evaluation circuit and having an anti-masking device comprising:

an optical transmitter;

an optical receiver for detecting at least one of optical changes in front of the detector and changes in the optical properties of the entrance window;

an evaluation circuit having proximity latch (PL) channel and an real time (RT) channel, the PL channel responding to temporally limited phenomena and the RT channel responding to temporally stable phenomena, wherein combined evaluation of the signals in both channels is performed.

2. The infrared detector according to claim 1, wherein the signal in each channel is compared with at least one threshold value and the combined evaluation is formed by a combination of the comparison results in the two channels.

3. The infrared detector according to claim 2, wherein in each channel a plurality of threshold values are defined for pre-alarm conditions in addition to a threshold value corresponding to the respective alarm threshold value.

4. The infrared detector according to claim 3, wherein if a pre-alarm signal is present in both the proximity latch (PL) channel and in the real time (RT) channel, a masking alarm is triggered.

5. The infrared detector according to claim 3, wherein if an alarm signal is present in the proximity latch (PL) channel without a substantially simultaneous pre-alarm in the real time (RT) channel, no masking alarm is triggered.

6. The infrared detector according to claim 1, further comprising a PIR channel for the evaluation of the signals of the infrared sensor, wherein the combined evaluation of the signals of the two channels of the anti-masking device is combined with the signal from the PIR channel, and in that intrusion or masking alarms are triggered on the basis of the signals in all three channels.

7. The infrared detector according to claim 6, wherein in the case of the coincidence of a masking alarm in the proximity latch (PL) channel and an intrusion alarm in the PIR channel, the intrusion alarm is suppressed.

8. The infrared detector according to claim 1, wherein the evaluation circuit includes a fuzzy logic processing circuit for performing the combined evaluation.

9. The infrared detector according to claim 1, wherein the evaluation circuit includes a neural network processing circuit for performing the combined evaluation.

10. The infrared detector according to claim 1, wherein the anti-masking device further comprises a first optical transmitter disposed on the outside of the front of the detector that exposes the space directly in front of the detector to radiation and a second optical transmitter which is disposed in the interior of the detector and directs its radiation at the entrance window.

11. The infrared detector according to claim 10, wherein the optical receiver is exposed to that radiation of the first optical transmitter that is reflected from the space immediately in front of the detector and to the radiation of the second optical transmitter that is transmitted by the entrance window.

12. The infrared detector according to claim 10, wherein the radiation from the second optical transmitter is directed onto the entrance window at a shallow angle of incidence.

13. A passive infrared detector comprising:

a housing having a front face and first and second side wall protrusions extending from said front face, said front face having an opening therein located between said side wall protrusions;

an entrance window disposed within said opening in said front face of said housing;

an infrared sensor responsive to infrared radiation incident on said entrance window; and an anti-masking device comprising:

an optical transmitter;

an optical receiver for detecting at least one of phenomena or optical changes in front of the detector and at least one of changes in the optical properties of the entrance window;

an evaluation circuit having the proximity latch (PL) channel and an real time (RT) channel, the PL channel responding to temporally limited phenomena and the RT channel responding to temporally stable phenomena, wherein combined evaluation of the signals in both channels is performed.

14. The infrared detector according to claim 13, further comprising:

a second optical transmitter which is disposed in the interior of the detector and directs its radiation at the entrance window; and wherein said first optical transmitter is disposed on the outside of the front of the detector that exposes the space directly in front of the detector to radiation.

15. The infrared detector according to claim 14, wherein the optical receiver is exposed to that radiation of the first optical transmitter that is reflected from the space immediately in front of the detector and to the radiation of the second optical transmitter that is transmitted by the entrance window.

16. The infrared detector according to claim 14, wherein the radiation from the second optical transmitter is directed onto the entrance window at a shallow angle of incidence.

17. The infrared detector according to claim 14, wherein at least one of said side wall protrusions includes a light duct formed therein, said light duct being in optical communication with said second optical transmitter and having an optical passage in communication with said entrance window.

18. The infrared detector according to claim 17, wherein the optical passage in communication with said entrance window projects the radiation from the second optical transmitter onto the entrance window at a shallow angle of incidence.

19. The infrared detector according to claim 17, wherein at least a portion of the side wall protrusion opposing said optical passage is provided with an infrared absorbing surface.

* * * * *